US008894558B2

(12) United States Patent
Matsuzaki

(10) Patent No.: US 8,894,558 B2
(45) Date of Patent: Nov. 25, 2014

(54) RECORDING MATERIAL PROCESSING APPARATUS AND RECORDING MATERIAL PROCESSING SYSTEM

(71) Applicant: Fuji Xerox Co., Ltd., Tokyo (JP)

(72) Inventor: Yoshitaka Matsuzaki, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 33 days.

(21) Appl. No.: 13/892,852

(22) Filed: May 13, 2013

(65) Prior Publication Data

US 2014/0159298 A1 Jun. 12, 2014

(30) Foreign Application Priority Data

Dec. 12, 2012 (JP) ..... 2012-271248

(51) Int. Cl.

| | |
|---|---|
| ***B65H 45/12*** | (2006.01) |
| ***B65H 37/04*** | (2006.01) |
| ***B65H 45/18*** | (2006.01) |
| ***B42C 19/02*** | (2006.01) |
| ***B42C 1/12*** | (2006.01) |
| ***B65H 37/06*** | (2006.01) |
| ***B42B 4/00*** | (2006.01) |
| ***G03G 15/00*** | (2006.01) |

(52) U.S. Cl.

CPC ..... *B65H 37/04* (2013.01); *B65H 45/18* (2013.01); *B65H 2801/27* (2013.01); *B42C 19/02* (2013.01); *B42C 1/12* (2013.01); *B65H 37/06* (2013.01); *B42B 4/00* (2013.01); *G03G 15/6538* (2013.01)

USPC ..... 493/445; 270/32; 270/58.07; 493/435; 493/437

(58) Field of Classification Search

CPC ..... B65H 45/12; B65H 45/16; B65H 45/18

USPC ..... 270/32, 58.07; 493/424, 434, 435, 436, 493/437, 442, 443, 444, 445

See application file for complete search history.

(56) References Cited

U.S. PATENT DOCUMENTS

| | | | | | |
|---|---|---|---|---|---|
| 4,812,195 | A | * | 3/1989 | Vijuk | 156/357 |
| 4,995,600 | A | * | 2/1991 | Kovac et al. | 270/45 |
| 5,169,376 | A | * | 12/1992 | Ries et al. | 493/445 |
| 5,180,151 | A | * | 1/1993 | Branecky et al. | 270/45 |
| 5,709,376 | A | | 1/1998 | Ushirogata | |

(Continued)

FOREIGN PATENT DOCUMENTS

| | | |
|---|---|---|
| JP | A-08-324874 | 12/1996 |
| JP | A-11-130338 | 5/1999 |

*Primary Examiner* — Leslie A Nicholson, III

(74) *Attorney, Agent, or Firm* — Oliff PLC

(57) ABSTRACT

A recording material processing apparatus includes: a stacker stacking recording materials to form a bundle; a pressing member including blade sections arranged at intervals to press portions of the bundle, where folds are to be formed, to move the portions in a recording material transport direction; a pair of first fold-forming rolls, each of which includes plural rolls arranged at intervals to enter between the blade sections when the blade sections press the portions, the pair of first fold-forming rolls forming the folds at intervals by nipping the portions pressed by the blade sections; and a pair of second fold-forming rolls, each of which includes plural rolls arranged at intervals to correspond to the blade sections, the pair of second fold-forming rolls further forming the folds on the bundle by nipping portions of the bundle, which exist between the folds formed by the pair of first fold-forming rolls.

11 Claims, 11 Drawing Sheets

(56) References Cited

U.S. PATENT DOCUMENTS 6,145,825 A 11/2000 Kunihiro et al.
6,855,101 B2 * 2/2005 Trovinger et al. ..... 493/445
7,121,993 B2 * 10/2006 Matsumoto ..... 493/434
7,137,944 B2 * 11/2006 Suzuki et al. ..... 493/405
8,028,980 B2 * 10/2011 Fukasawa et al. ..... 270/45
8,146,903 B2 * 4/2012 Ryan ..... 270/37

* cited by examiner

RECORDING MATERIAL PROCESSING APPARATUS AND RECORDING MATERIAL PROCESSING SYSTEM

CROSS REFERENCE TO RELATED APPLICATIONS

This application is based on and claims priority under 35 USC §119 from Japanese Patent Application No. 2012-271248 filed Dec. 12, 2012.

BACKGROUND

1. Technical Field

The present invention relates to a recording material processing apparatus and a recording material processing system.

2. Related Art

Many sheet processing devices are known in which various types of sheet aligning functions are provided.

SUMMARY

According to an aspect of the present invention, there is provided a recording material processing apparatus including: a stacker that stacks recording materials that are sequentially transported to form a bundle of recording materials; a pressing member that includes blade sections arranged at intervals in a width direction of the bundle of recording materials, the blade sections pressing portions of the bundle of recording materials, where folds are to be formed, stacked on the stacker, to thereby move the portions of the bundle of recording materials, where the folds are to be formed, in a recording material transport direction; a pair of first fold-forming rolls, each of which includes plural rolls arranged at intervals so as to enter between the blade sections when the blade sections press the portions of the bundle of recording materials where folds are to be formed, the pair of first fold-forming rolls forming the folds at intervals by nipping the portions of the bundle of recording materials, where folds are to be formed, having been pressed by the blade sections; and a pair of second fold-forming rolls provided at a downstream side of the pair of first fold-forming rolls in the recording material transport direction, each of which includes plural rolls arranged at intervals so as to correspond to positions where the blade sections of the pressing member are arranged, the pair of second fold-forming rolls further forming the folds on the bundle of recording materials by nipping portions of the bundle of recording materials, which exist between the folds formed by the pair of first fold-forming rolls.

BRIEF DESCRIPTION OF THE DRAWINGS

An exemplary embodiment of the present invention will be described in detail based on the following figures, wherein.

DETAILED DESCRIPTION

Hereinafter, an exemplary embodiment according to the present invention will be described in detail with reference to the attached drawings.

Figure 1:
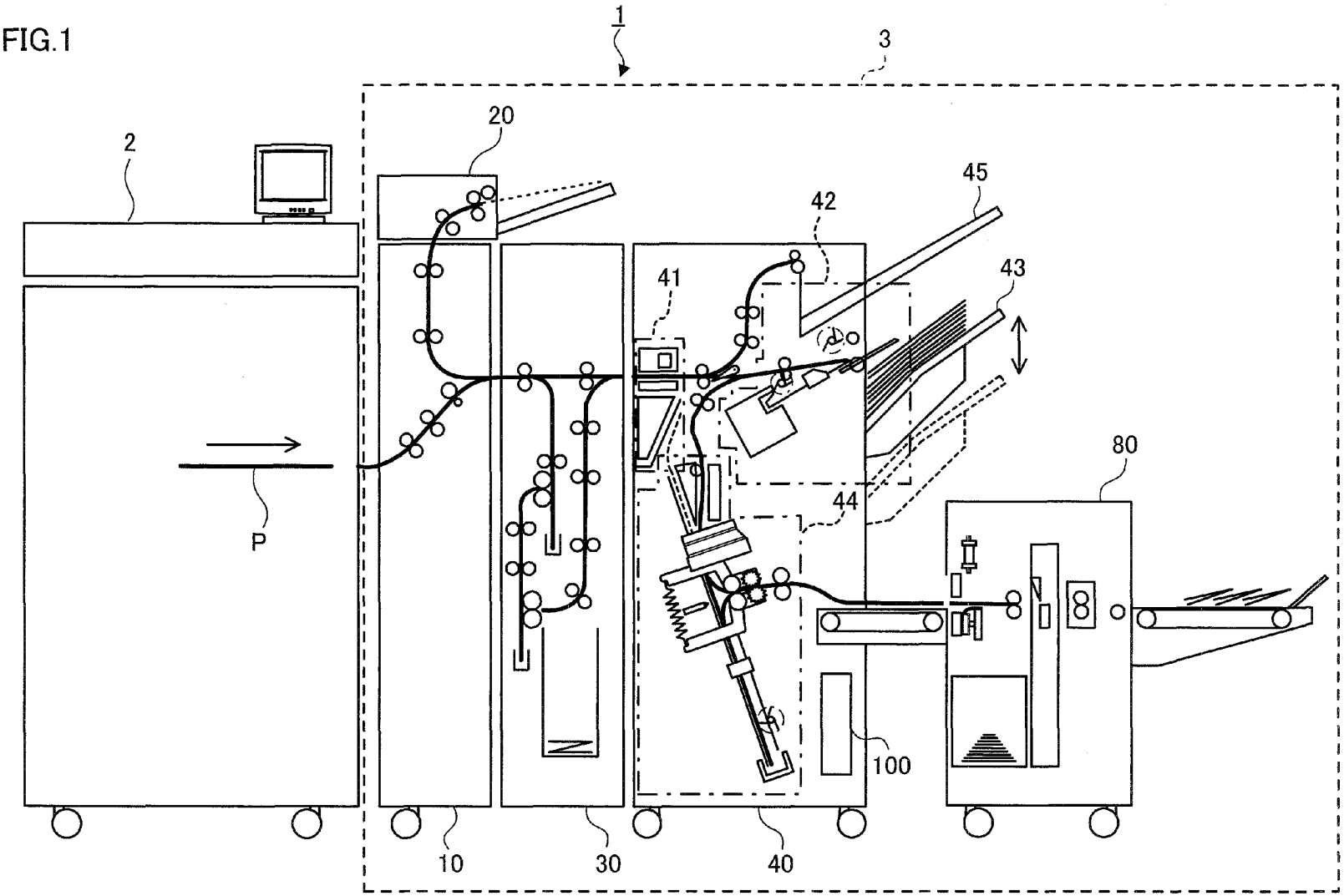
FIG. 1 is a diagram showing an entire configuration of a sheet processing system to which the exemplary embodiment is applied.

FIG. 1 is a diagram showing an entire configuration of a sheet processing system 1 to which the exemplary embodiment is applied.

The sheet processing system 1 shown in FIG. 1 includes an image forming apparatus 2 that forms a color image on a sheet P, which is an example of a recording material, by the electrophotographic method, for example, and a sheet processing apparatus 3 that applies predetermined processes on the sheet P on which the image has been formed by the image forming apparatus 2. It should be noted that, in the exemplary embodiment, the image forming apparatus 2 that uses toner to form an image by the electrophotographic system is shown as an example; however, the image forming apparatus 2 may be configured with, for example, an ink jet printer.

The sheet processing apparatus 3 includes a transport device 10 that further transports the sheet P outputted from the image forming apparatus 2 to the downstream side and an interleaf supply device 20 that supplies an interleaf such as a thick sheet and a window sheet to the sheet P transported by the transport device 10. The sheet processing apparatus 3 also includes a folding device 30 that performs a folding process, such as an inside three-folding (C-folding) and an outside three-folding (Z-folding), on the sheet P transported from the transport device 10 and a first post-processing device 40 that is provided at a downstream side of the folding device 30 and performs punching, end-stitching or saddle-stitching on the sheet P. The sheet processing apparatus 3 further includes a second post-processing device 80 that is provided at a downstream side of the first post-processing device 40 and performs further processing on the bundle of sheets PS (booklet) having been subjected to the processes of center folding and saddle-stitching. Moreover, the sheet processing apparatus 3 is provided with a controller 100 that is configured with a program-controlled CPU (central processing unit) to control the entire sheet processing apparatus 3.

As shown in FIG. 1, the first post-processing device 40 includes: a punching unit 41 that performs hole-making (punching) on the sheet P and an end-stitching stapler unit 42 that performs stitching on an end portion of a bundle of sheets PS; a first stacking portion 43 for stacking the bundle of sheets PS, which is end-stitched, so that a user can easily pick up the bundle of sheets PS; and a saddle-stitching unit 44 that performs the processes of center folding and saddle-stitching on the bundle of sheets PS to provide a booklet of a double-page spread. Further, the first post-processing device 40 includes a second stacking portion 45 that stacks sheets P that are not subjected to any process in the first post-processing device 40 or sheets P having been subjected to the punching process only.

Figure 2:
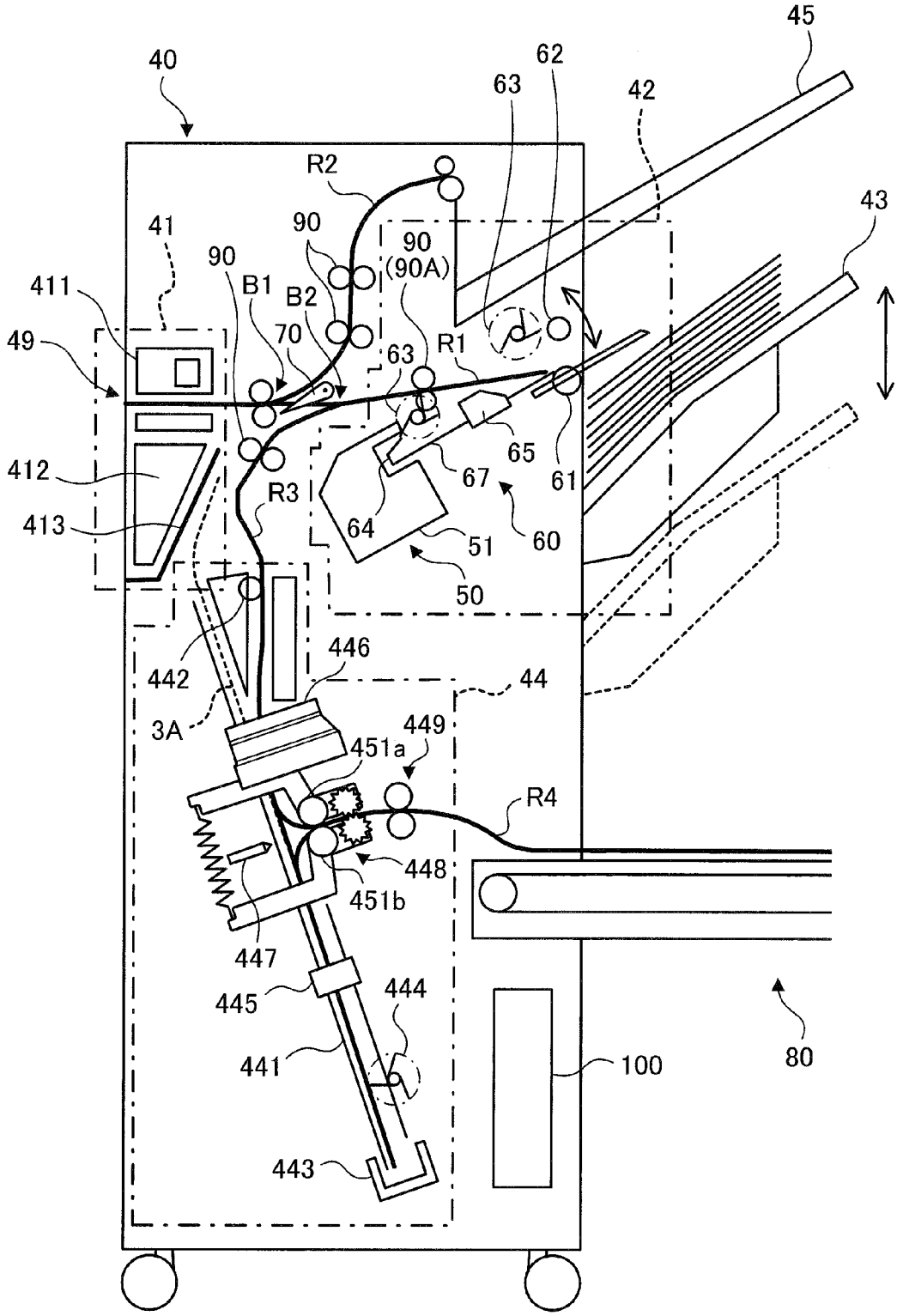
FIG. 2 is a diagram illustrating a configuration of a first post-processing device.

FIG. 2 is a diagram illustrating a configuration of the first post-processing device 40.

In the exemplary embodiment, the first post-processing device 40 is an example of a recording material processing apparatus. As shown in the figure, the first post-processing device 40 is provided with a receiving port 49 for receiving the sheet P transported from the folding device 30. The first post-processing device 40 also includes a first sheet transport route R1 that is provided to extend from the receiving port 49 to the end-stitching stapler unit 42 to be used for transporting the sheet P received at the receiving port 49 toward the end-stitching stapler unit 42.

Further, the first post-processing device 40 is provided with a second sheet transport route R2 that branches off at a first branch portion B1 from the first sheet transport route R1 to be used for transporting the sheet P toward the second stacking portion 45. Still further, the first post-processing device 40 is provided with a third sheet transport route R3 that branches off at a second branch portion B2 from the first sheet transport route R1 to be used for transporting the sheet P toward the saddle-stitching unit 44. Still further, the first post-processing device 40 is provided with a fourth sheet transport route R4 that transports the bundle of sheets PS having been saddle-stitched at the saddle-stitching unit 44 toward the outside of the device while performing center folding at a saddle-stitching position. It should be noted that, in the exemplary embodiment, the second branch portion B2 is positioned below the first branch portion B1 in a transport direction of the sheet P in the first sheet transport route R1.

In the exemplary embodiment, a switch gate 70, which is arranged between the first branch portion B1 and the second branch portion B2 to switch (set) the route of transporting the sheet P to any of the first sheet transport routes R1 to the third sheet transport route R3, is provided. Moreover, each of the first sheet transport routes R1 to the third sheet transport route R3 is provided with a transport roll 90 that is configured with a pair of roll-like members to drive rotationally for transporting the sheet P on the sheet transport route.

Here, the punching unit 41 is provided beside the receiving port 49 and performs hole making (punching) of two holes, four holes and so forth on the sheet P having been transported to the first post-processing device 40. Here, the punching unit 41 is provided with a unit main body 411 that includes a punching blade and performs punching of two holes, four holes and so forth on the sheet P and a container 412 arranged beneath the unit main body 411 to contain punched chips generated in the punching process by the unit main body 411. Moreover, the punching unit 41 is provided with a partition wall 413 that is arranged between the inside of the first post-processing device 40 and the container 412 to separate the portion where the container 412 is located and the inside of the first post-processing device 40.

Next, the end-stitching stapler unit 42 will be described.

The end-stitching stapler unit 42 is provided with a sheet stacker 60 that includes a support plate 67 arranged with inclination to support the sheet P from beneath and stacks the necessary number of sheets P to generate the bundle of sheets PS and a stitching process portion 50 that performs staple-stitching (end-stitching) on the end portion of the bundle of sheets PS generated by the sheet stacker 60. The end-stitching stapler unit 42 is also provided with a transport roll 61 that is rotatably provided to be used for transporting the bundle of sheets PS generated by the sheet stacker 60 toward the first stacking portion 43. Further, the end-stitching stapler unit 42 includes a movable roll 62 that is movable to a position to be retracted from the transport roll 61 and a position to be in pressure contact with the transport roll 61.

Here, at the time when the process by the end-stitching stapler unit 42 is performed, first, the sheet P transported from the folding device 30 (refer to FIG. 1) is received at the receiving port 49. Thereafter, the sheet P is transported along the first sheet transport route R1 and reaches the end-stitching stapler unit 42. Then, the sheet P is transported over the support plate 67 and falls onto the support plate 67. The sheet P moves by sliding on the support plate 67 by inclination assigned to the support plate 67 while being supported from beneath by the support plate 67.

Thereafter, the sheet P is caused to reach an end guide 64 attached to an end portion of the support plate 67. Specifically, in the exemplary embodiment, the end guide 64 extending upwardly in the figure is provided to the end portion of the support plate 67, and the sheet P having moved on the support plate 67 reaches the end guide 64. In the exemplary embodiment, this makes the movement of the sheet P stop. Hereinafter, this operation is performed every time the sheet P is transported from the upstream side, and thereby the bundle of sheets PS, which is in the state where trailing edge portions of the sheets P are aligned, is generated on the support plate 67.

It should be noted that, in the exemplary embodiment, a rotation paddle 63 for moving the sheet P on the support plate 67 toward the end guide 64 is also provided; accordingly, the sheet P moves to the end guide 64 by the inclination assigned to the support plate 67 and the rotation paddle 63. In addition, in the exemplary embodiment, though description was omitted above, a sheet width position aligning member 65 for aligning a position of the bundle of sheets PS in the width direction is provided. In the exemplary embodiment, every time the sheet P is supplied onto the support plate 67, the end portion (side portion) of the sheet P in the width direction is pressed by the sheet width position aligning member 65, and thereby the position of the sheet P (bundle of sheets P) in the width direction is also aligned.

When the sheets P of a predetermined number are stacked on the support plate 67, staple-stitching on the end portion of the bundle of sheets PS is performed by the stapler head 51 provided to the stitching process portion 50. It should be noted that the stapler head 51 performs staple-stitching by pressing a metal-made staple (U-like stitching needle) into the bundle of sheets PS. Thereafter, in the exemplary embodiment, the movable roll 62 moves toward the transport roll 61, and the bundle of sheets PS is sandwiched by the movable roll 62 and the transport roll 61. Then, the transport roll 61 drives rotationally to transport the bundle of sheets PS to the first stacking portion 43.

It should be noted that the stapler head 51 is provided to be movable to the back side and the front side of the device in the figure, and in the exemplary embodiment, the stapler head 51 is configured to be capable of performing the stitching process on the sheet P at plural locations. To specifically describe with reference to FIG. 3 (the diagram showing the operation of the stapler head 51 when the sheet stacker 60 is viewed from above), in the exemplary embodiment, the stapler head 51 is configured to move along the depth direction of the first post-processing device 40, which is a direction orthogonal to the transport direction of the sheet P (bundle of sheets PS), and accordingly, it is possible to perform the stitching process at the plural locations of the bundle of sheets PS that are different from one another.

Figure 3:
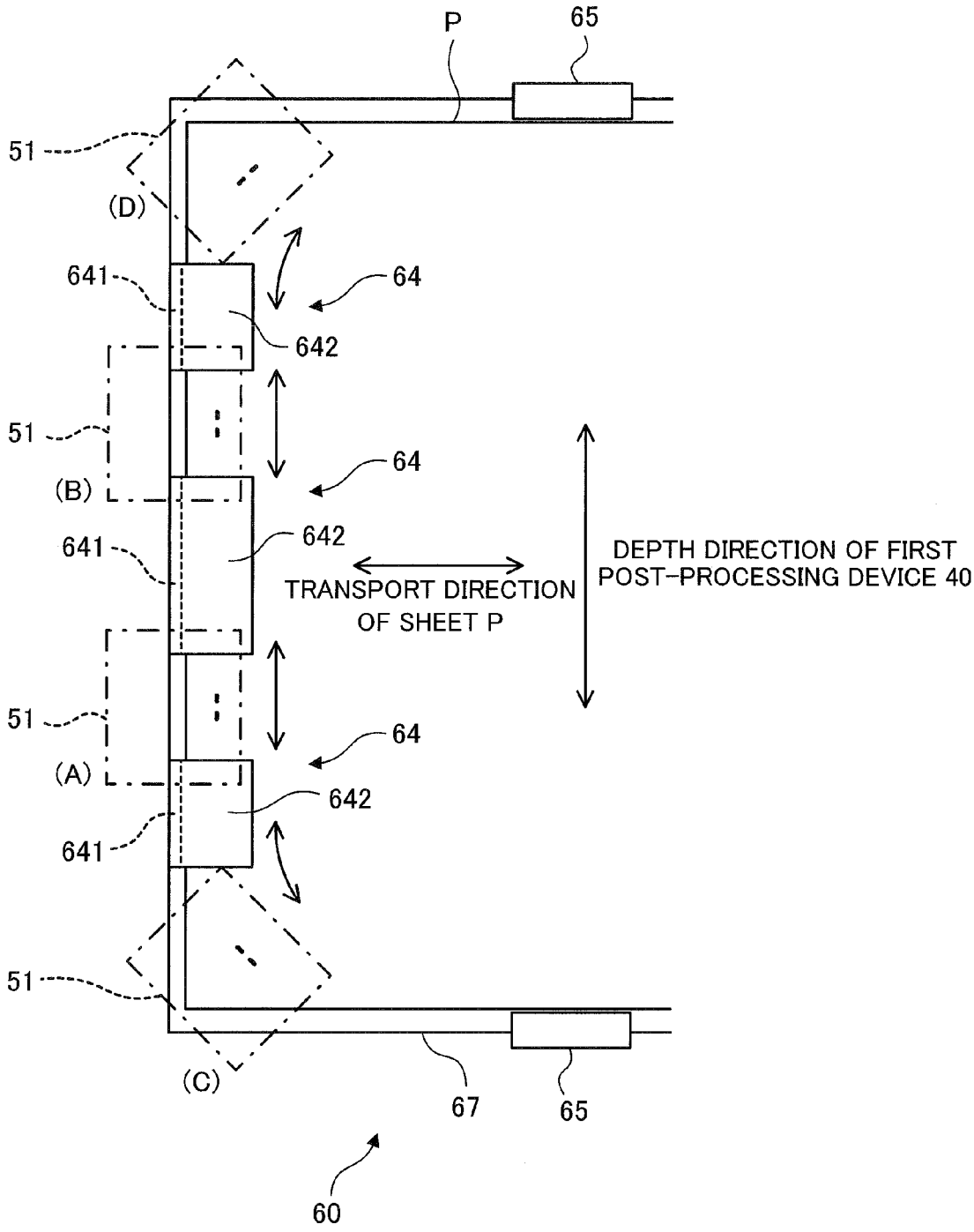
FIG. 3 is a diagram showing an operation of a stapler head when a sheet stacker is viewed from above.

To describe further, as shown in FIG. 3, the stapler head 51 in the exemplary embodiment stops at two points that are positioned at different locations from each other in the depth direction of the first post-processing device 40 (position (A) and position (B) in FIG. 3), and performs the stitching process at these two points (two-point end-stitching process), for example. Or, for example, the stapler head 51 stops at one end of the bundle of sheets PS (one corner portion of the bundle of sheets PS: position (D) in FIG. 3), and performs the stitching process at this stop position (one-point end-stitching process).

Moreover, for example, the stapler head 51 stops at the other end of the bundle of sheets PS (the other corner portion of the bundle of sheets PS: position (C) in FIG. 3), and performs the stitching process at this stop position (one-point end-stitching process). Here, in the exemplary embodiment, the stapler head 51 moves linearly between the position (A) and the position (B); however, between the position (A) and the position (C) and between the position (B) and the position (D), the stapler head 51 moves with rotation of, for example, 45 degrees.

It should be noted that, though description is omitted above, as shown in FIG. 3, plural end guides 64 are provided in the exemplary embodiment. The end guides 64 are arranged at locations that are different from one another in the depth direction of the first post-processing device 40 (direction orthogonal to the transport direction of the sheet P).

Moreover, as shown in FIG. 3, each of the end guides 64 is configured with a regulation portion 641 that is arranged in a relation orthogonal to the support plate 67 to regulate the movement of the sheet P by being reached by the end portion of the sheet P and a facing piece 642 that is connected to the regulation portion 641 and arranged to face the support plate 67. In the exemplary embodiment, at the time when the sheets P are stacked on the support plate 67, the end portion of the sheet P enters between the facing piece 642 and the support plate 67, and this end portion reaches the regulation portion 641. Accordingly, the aligning process of the sheets P is performed.

It should be noted that, though description was omitted above, when the stitching process is performed at the position (A) in FIG. 3 by the stapler head 51, the stitching process is performed through a gap between the facing piece 642 positioned at the center in the figure (the center in the vertical direction) in FIG. 3 and the facing piece 642 positioned at a lower side in the figure. When the stitching process is performed at the position (B) in FIG. 3 by the stapler head 51, the stitching process is performed through a gap between the facing piece 642 positioned at an upper side in the figure and the facing piece 642 positioned at the center in the figure.

Next, with reference to FIG. 2 again, the saddle-stitching unit 44 will be described.

As shown in the figure, the saddle-stitching unit 44 is provided with: a sheet stacker 441 as an example of a stacker that is arranged with inclination to the vertical direction and stacks a necessary number of sheets P after image formation to form the bundle of sheets (bundle of recording materials) PS; a discharge roll 442 that discharges the sheets P sequentially transported via the third sheet transport route R3 to the sheet stacker 441; and an end guide 443 that moves along the sheet stacker 441 for determining the saddle-stitching position or the center folding position. The saddle-stitching unit 44 is also provided with plural sheet aligning members 444 that transport the sheets P stacked on the sheet stacker 441 toward the end guide 443. The sheet aligning member 444 is configured with a rotating paddle.

Moreover, the saddle-stitching unit 44 is provided with a sheet width aligning member 445 configured with a pair of matching plate that slides and moves for aligning the sheets P stacked on the sheet stacker 441 in the width direction and a stapler 446 that performs saddle-stitching on the bundle of sheets PS stacked on the sheet stacker 441. In the exemplary embodiment, the stapler 446 functions as a stitching unit that stitches a location in the bundle of sheets PS stacked on the sheet stacker 441, where a fold is to be formed, by use of staples (stitching needles). The saddle-stitching unit 44 is further provided with: a folder knife 447 that advances from the back surface side toward the front surface side of the sheet stacker 441 for folding the bundle of sheets PS having been saddle-stitched by the stapler 446 at the saddle-stitching position; a folder roll portion 448 configured with a pair of rolls that nips the bundle of sheets PS on which folding is started by the folder knife 447; and a transport roll 449 that transports the bundle of sheets PS nipped by the folder roll portion 448 toward the second post-processing device 80.

In the case where a booklet subjected to center folding and saddle stitching is to be formed by the first post-processing device 40, first, the sheet P is received at the receiving port 49, and the sheet P is transported along the first sheet transport route R1 until the trailing edge of the sheet P reaches the switch gate 70. It should be noted that, at this time, the switch gate 70 is arranged to guide the sheet P to the first sheet transport route R1 (end-stitching stapler unit 42). Then, after the trailing edge of the sheet P reaches the switch gate 70, transportation of the sheet P is temporarily halted.

Thereafter, the switch gate 70 is driven to press the trailing edge of the sheet P from the lateral direction, and thereby the trailing edge of the sheet P enters into the third sheet transport route R3. Then, reverse rotation of the transport roll 90 (transport roll indicated by the sign 90A in the figure) is started. Accordingly, transportation of the sheet P along the third sheet transport route R3 is started, and the sheet P is forwarded into the discharge roll 442 provided in the saddle-stitching unit 44. Thereafter, the sheet P is sent away to the sheet stacker 441 by the discharge roll 442. Hereinafter, every time a new sheet P is transported, these operations are repeated.

Consequently, the sheets of the number such as 5, 10, 15 and so forth, set by, for example, a controller (not shown) in the image forming apparatus 2 are stacked at the sheet stacker 441. It should be noted that, when the sheets P are stacked at the sheet stacker 441, the sheet aligning members 444 rotate and press the sheets P to be stacked against the end guide 443 to assist sheet alignment. In addition, the sheet width aligning member 445 slides and moves along the width direction of the sheets P to be stacked on the sheet stacker 441 and performs sheet alignment on the stacked sheets P from the width direction.

Here, though depending upon the size of the sheet P, after the sheets P of a predetermined number are stacked on the sheet stacker 441, the end guide 443 moves upwardly and the center portion of the sheets P (bundle of sheets PS) is located to the stapling position by the stapler 446. At this time, the bundle of sheets PS elevated by the end guide 443 moves upwardly along the sheet stacker 441; however, if the bundle of sheets PS is long the length direction thereof, the bundle of sheets PS is forwarded along the broken line 3A in the figure.

It should be noted that, in this case, there is a possibility that the leading edge of the bundle of sheets PS reaches the punching unit 41 and movement of the bundle of sheets PS is restricted; however, in the exemplary embodiment, the bundle of sheets PS is guided to a route beside the punching unit 41 by the partition wall 413 provided to the punching unit 41, and accordingly, movement of the bundle of sheets PS is not restricted. It should be noted that it may be possible to omit the partition wall 413 and to guide the bundle of sheets PS to the route beside the punching unit 41 by a side surface of the container 412.

When the center portion of the sheet P reaches the stapling position by the stapler 446, saddle stitching for part of the sheet P (for example, the center portion) is performed by the stapler 446. Subsequently, the bundle of sheets PS, on which the saddle stitching is finished, is moved such that the folded portion thereof (for example, the center portion of the sheet P) coincides with a tip end position of the folder knife 447 by downward movement of the end guide 443. It should be noted that the folder knife 447 is retracted behind the sheet stacker 441 in the stage of stacking the sheets to the sheet stacker 441, the stage of saddle stitching by the stapler 446 and the stage of transporting the sheets after performing saddle stitching.

After the folded portion of the bundle of sheets PS is moved to the tip end position of the folder knife 447, the folder knife 447 is pushed from the back surface side toward the front surface side of the sheet stacker 441. This causes the folder knife 447 to be projected to the front surface side of the sheet stacker 441 through an aperture (not shown) formed in the sheet stacker 441. Then, according to this projection, the center portion of the bundle of sheets. PS is pushed out toward an upper folder roll 451*a* and a lower folder roll 451*b* of the folder roll portion 448, and is nipped between the upper folder roll 451*a* and the lower folder roll 451*b*. Thereafter, the bundle of sheets PS is transported to the downstream side by the upper folder roll 451*a* and the lower folder roll 451*b*, and the bundle of sheets PS is passed to the transport roll 449. Then, the bundle of sheets PS, to which the center folding and saddle-stitching processes are applied, is forwarded to the second post-processing device 80 by the transport roll 449 via the fourth sheet transport route R4.

It should be noted that the case where the stitching process by the stapler unit 42 and center folding and saddle stitching by the saddle-stitching unit 44 are performed is described above; however, the sheets P on which these two processes are not performed or the sheets P on which only the punching process by the punching unit 41 is performed are guided to the second sheet transport route R2 by the switch gate 70, and are stacked on the second stacking portion 45.

Next, relation between the stapler 446, the folder knife 447, the folder roll portion 448 and the transport roll 449 will be described in further detail.

Figure 4:
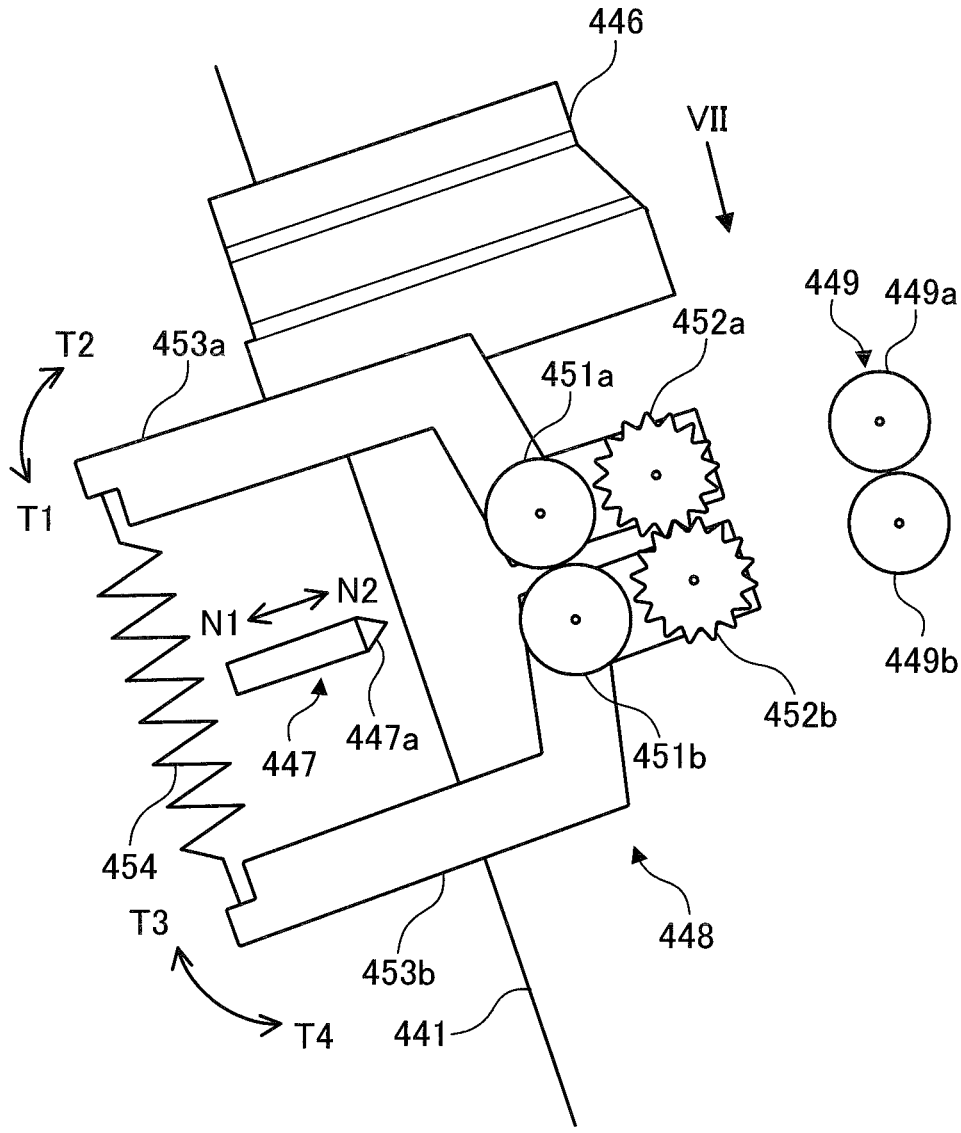
FIG. 4 is a diagram that enlarges a portion where a stapler, a folder knife, a folder roll portion and a transport roll are arranged.

FIG. 4 is a diagram that enlarges a portion where the stapler 446, the folder knife 447, the folder roll portion 448 and the transport roll 449 are arranged.

As shown in the figure, the folder roll portion 448 includes: the upper folder roll 451*a*; the lower folder roll 451*b*; gears 452*a* and 452*b*; an upper arm 453*a*; a lower arm 453*b*; and a spring member 454.

Figure 5:
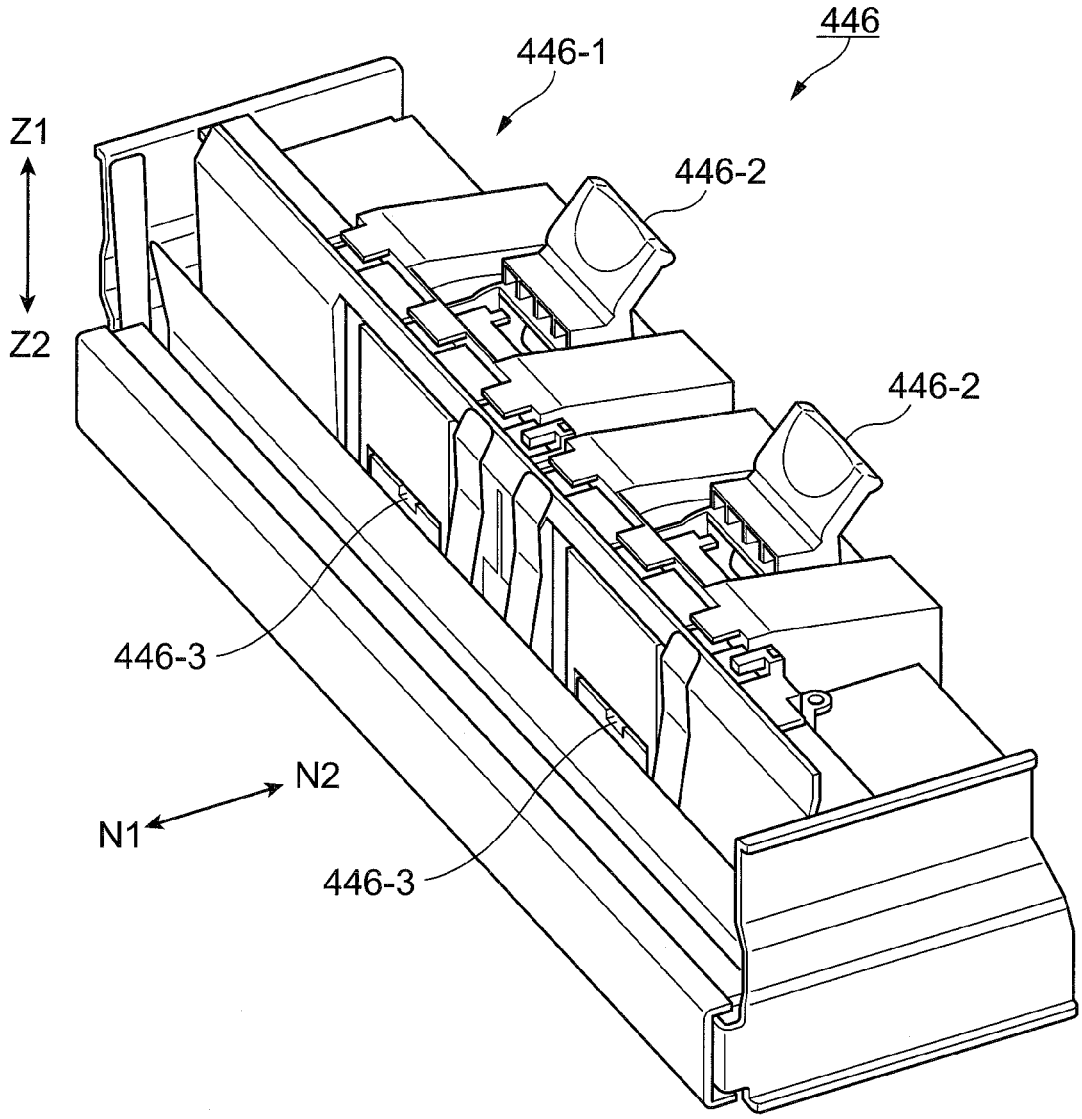
FIG. 5 is a diagram illustrating a configuration of the stapler.

FIG. 5 is a diagram illustrating a configuration of the stapler 446.

As shown in the figure, the stapler 446 includes a stapler main body 446-1 and a staple cartridge 446-2 that contains staples (stitching needles) for performing saddle stitching on the bundle of sheets PS. The staple cartridge 446-2 is detachably attached to the stapler main body 446-1, and when the staples are to be replenished, the staple cartridge 446-2 is detached from the stapler main body 446-1 to replenish the staples. After the staples are replenished, the staple cartridge 446-2 is fitted into the stapler main body 446-1 to be attached. The stapler 446 of the exemplary embodiment includes two staple cartridges 446-2, and accordingly, staples are put at two locations on the bundle of sheets PS to perform saddle stitching for the bundle of sheets PS. At this time, a not-shown head arranged inside the stapler main body 446-1 pushes out the staples one by one, and thereby the staples are ejected in a direction N1 from a staple ejection port 446-3 to be put on the bundle of sheets PS.

In the exemplary embodiment, the stapler 446 is arranged assuming that a direction Z1 is on an upper side. Consequently, the staple ejection port 446-3 is positioned at a location that is at a lower portion of the stapler 446. By doing so, the position of the staple ejection port 446-3, which is a position for ejecting the staples, is located closer to the upper folder roll 451*a* and the lower folder roll 451*b* in the vertical direction of the stapler 446. In this case, after the bundle of sheets PS is saddle-stitched, the moving distance when the bundle of sheets PS is to be moved to the position of center folding is reduced, to thereby make it easier to render the first post-processing device 40 more compact in the vertical direction.

In the exemplary embodiment, the positional relation between the stapler 446 and the folder roll portion 448 is such that the stapler 446 is positioned at an upper side while the folder roll portion 448 is positioned at a lower side. In this case, the upper folder roll 451*a*, the loser folder roll 451*b*, the upper arm 453*a* and the lower arm 453*b* are arranged below the stapler 446.

By doing so, it is possible to make the length of the first post-processing device 40 in the width direction (in FIG. 4, the lateral direction) smaller. Further, the safety level when the staple cartridge 446-2 is attached or detached is improved, and efforts for attaching or detaching the staple cartridge 446-2 are reduced. Hereinafter, these matters will be described in further detail.

Figure 6:
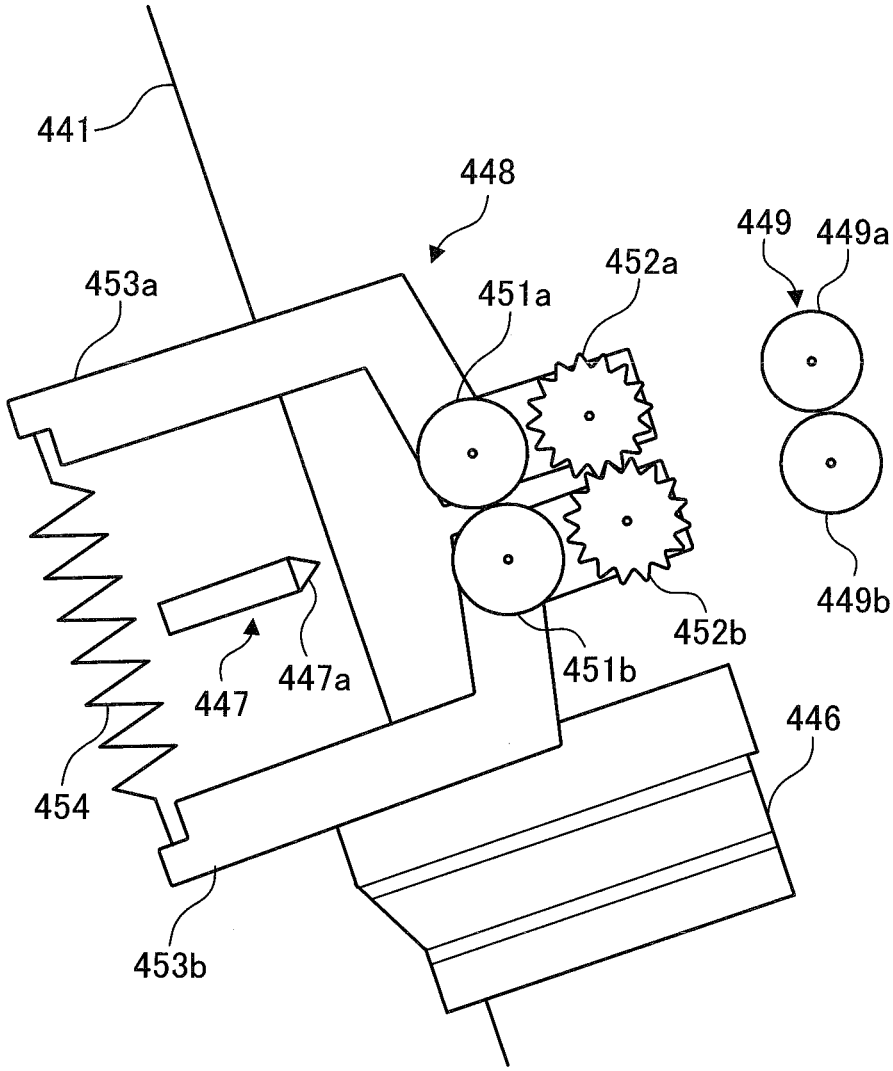
FIG. 6 is a diagram illustrating a positional relation between the stapler and the folder roll portion in a case where the folder roll portion is assumed to be at an upper side and the stapler is assumed to be at a lower side.

FIG. 6 is a diagram illustrating a positional relation between the stapler 446 and the folder roll portion 448 in the case where the folder roll portion 448 is assumed to be at an upper side and the stapler 446 is assumed to be at a lower side.

In the mode shown in FIG. 4, it is possible to arrange the upper arm 453*a* and the lower arm 453*b* at a further lower portion of the first post-processing device 40. Moreover, since the sheet stacker 441 is arranged with inclination in an oblique direction from top left to bottom right as shown in FIGS. 2 and 4, it becomes possible to make a space larger, where the upper arm 453*a* and the lower arm 453*b* are to be arranged, by arranging the upper arm 453*a* and the lower arm 453*b* at a further lower portion of the first post-processing device 40. In other words, when the upper arm 453*a* and the lower arm 453*b* are arranged at a further upper portion of the first post-processing device 40 as shown in FIG. 6, the length of the first post-processing device 40 in the width direction is apt to be longer; however, it becomes possible to reduce the length of the first post-processing device 40 in the width direction by arranging the upper arm 453*a* and the lower arm 453*b* at a further lower portion of the first post-processing device 40.

In addition, in the case of the mode in FIG. 6, it is necessary to arrange the stapler 446 with the direction Z2 in FIG. 5 being located at an upper side for arranging the upper folder roll 451*a*, the lower folder roll 451*b* and the staple ejection port 446-3 at adjacent positions. Consequently, the staple ejection port 446-3 is arranged at the position in the upper portion of the stapler 446 and is also arranged at the position adjacent to the upper folder roll 451*a* and the lower folder roll 451*b*.

In this case, when the staple cartridge 446-2 is detached and attached for replenishing the staples, poor operability is caused by detaching and attaching the staple cartridge 446-2 from beneath the stapler 446. Accordingly, detachment and attachment of the staple cartridge 446-2 is carried out from above the stapler 446 or from behind the stapler 446, which is opposite to the location where the bundle of sheets PS is stitched. However, in this case, there is the fourth sheet transport route R4 (refer to FIG. 2) for the bundle of sheets PS above and behind the stapler 446, and there are also the upper folder roll 451*a*, the lower folder roll 451*b*, the transport roll 449 and the like; therefore, operability is poor. Further, since the folder knife 447 is projected at the position, there is a high risk. To avoid this, it may be considered that, for example, the stapler 446 is formed as a mechanism capable of being pulled toward the front side, and after the stapler 446 is pulled out to the front side, the staple cartridge 446-2 is detached and attached. However, in this system, the mechanism around the stapler 446 increases in complexity and operability in replenishing the staples becomes worse.

On the other hand, in the case where the stapler 446 is positioned at the upper side while the folder roll portion 448 is positioned at the lower side as in the exemplary embodiment shown in FIG. 4, if the staple cartridge 446-2 is detached and attached from above or behind the stapler 446, since the upper folder roll 451*a*, the lower folder roll 451*b*, the transport roll 449 and the like do not exist there, the operability is improved. Also, safety issues rarely occur. Further, the efforts in detaching and attaching the staple cartridge 446-2 are easily reduced.

Figure 7:
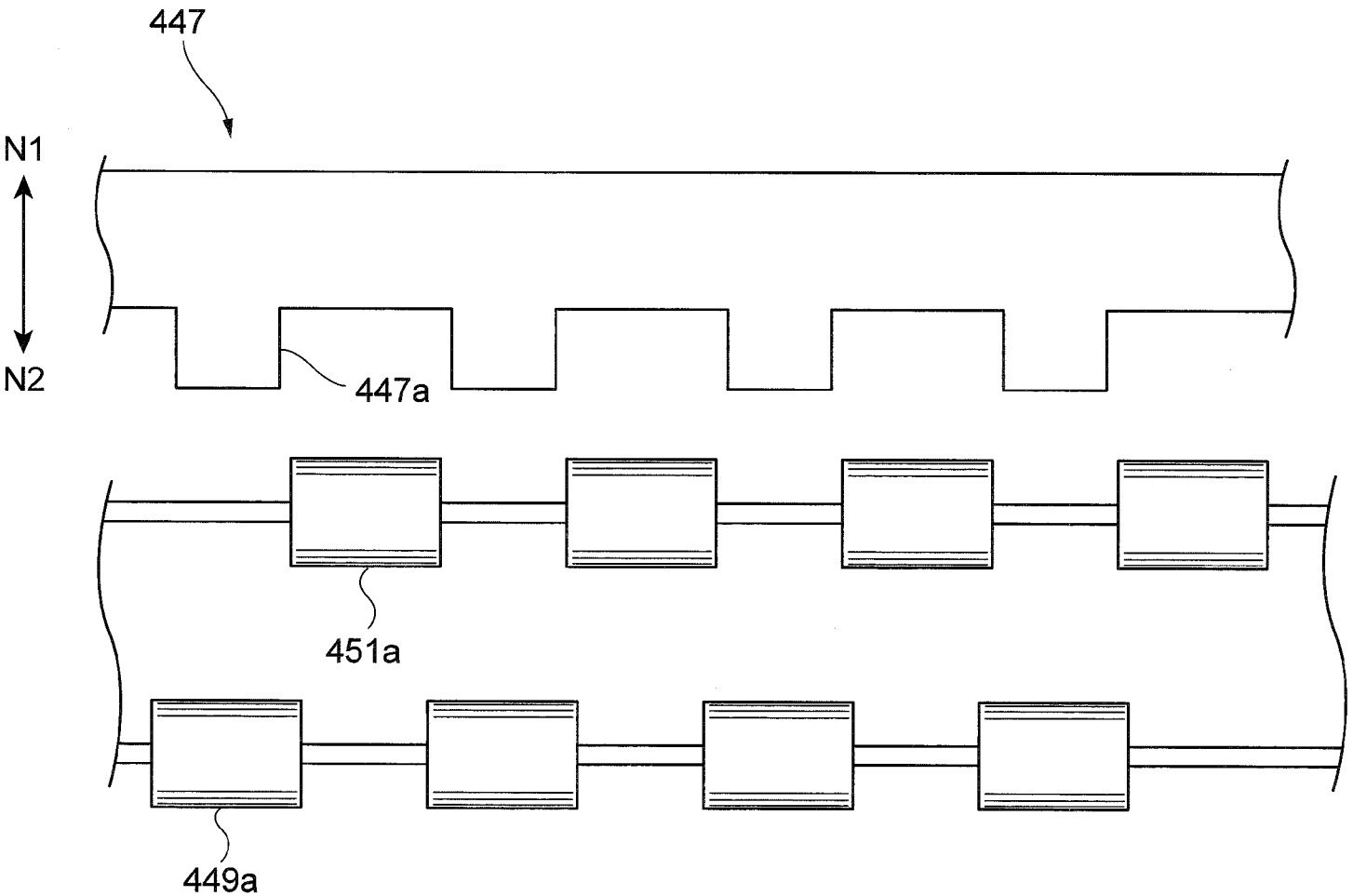
FIG. 7 is a diagram as viewed from the direction VII in FIG. 4, which illustrates a relation between the folder knife, an upper folder roll and the transport roll from a different angle.

FIG. 7 is a diagram as viewed from the VII direction in FIG. 4, which illustrates a relation between the folder knife 447, the upper folder roll 451*a* and the transport roll 449 from a different angle.

Hereinafter, by use of FIGS. 4 and 7, each of the folder knife 447, the upper folder roll 451*a* and the transport roll 449 will be described.

The folder knife 447 is an example of a pressing member that is arranged below the stapler 446, and is a plate member made of, for example, stainless steel. The folder knife 447 has blade sections 447*a* that are arranged at intervals in the width direction of the bundle of sheets PS. Tip end portions of the blade sections 447*a* are ground to have a thickness of, for example, 0.5 mm.

The folder knife 447 is movable between the upstream side and the downstream side in the sheet transport direction. In the figure, directions in which the folder knife 447 is movable are indicated as the N1 direction and the N2 direction. When the sheets P are stacked on the sheet stacker 441, the folder knife 447 moves in the N1 direction and is retracted behind the sheet stacker 441. On the other hand, when a fold is to be made on the bundle of sheets PS, the folder knife moves in the N2 direction and is projected toward the N2 direction while pressing the tip end portions of the blade sections 447*a* against the bundle of sheets PS. By performing an operation like this by the folder knife 447, the portion of the bundle of sheets PS where the fold is to be made are projected toward the N2 direction, while an upper end portion and a lower end portion of the bundle of sheets PS are left in the sheet stacker 441. In other words, the fold portion of the bundle of sheets PS is transported first in the N2 direction, and the upper end portion and the lower end portion of the bundle of sheets PS are finally transported. As a result, the bundle of sheets PS is transported in the N2 direction while center-folded with the fold portion being as a center. In this manner, the folder knife 447 presses the portion of the bundle of sheets PS where the fold is to be made, to thereby move the portion where the fold is to be made in the sheet transport direction (N2 direction), and accordingly, the bundle of sheets PS is center-folded.

The upper folder roll 451*a* and the lower folder roll 451*b* are an example of a pair of first fold-forming rolls, and are the rolls whose surface is made of, for example, urethane rubber. Both of the upper folder roll 451*a* and the lower folder roll 451*b* are connected to a not-shown driving source such as a motor to be driving rolls capable of generating a rotational force. The bundle of sheets PS is nipped between the upper folder roll 451*a* and the lower folder roll 451*b* and transported toward the transport roll 449 by the rotational force.

Each of the upper folder roll 451*a* and the lower folder roll 451*b* is configured with plural rolls that are arranged at intervals in an axial direction (the width direction of the bundle of sheets PS). The plural rolls of each of the upper folder roll 451*a* and the lower folder roll 451*b* have the same length in the axial direction and are arranged to face each other. It should be noted that, in the exemplary embodiment, four rolls are arranged in the axial direction in each of the upper folder roll 451*a* and the lower folder roll 451*b*. Moreover, the plural rolls in each of the upper folder roll 451*a* and the lower folder roll 451*b* are arranged so as to enter between the blade sections 447*a* of the folder knife 447 in the axial direction when the blade sections 447*a* is moved in the N2 direction.

Then, after the folder knife 447 moves in the N2 direction and the blade sections 447*a* press the portion of the bundle of sheets PS where the fold is to be made, the portion where the fold is to be made is nipped between the upper folder roll 451*a* and the lower folder roll 451*b*. As will be described in detail later, between the upper folder roll 451*a* and the lower folder roll 451*b*, a pressing force for pressing each other is acting, and thereby it is possible to form the fold on the bundle of sheets PS by the pressing force. However, since the fold is made at portions where the bundle of sheets PS is nipped between the plural rolls of the upper folder roll 451*a* and the lower folder roll 451*b*, the folds are formed at intervals. It should be noted that, hereinafter, the upper folder roll 451*a* and the lower folder roll 451*b* are collectively referred to as "folder roll 451" in some cases.

The transport roll 449 is constituted by an upper transport roll 449*a* and a lower transport roll 449*b*, and is an example of a pair of second fold-forming rolls arranged at the downstream side of the upper folder roll 451*a* and the lower folder roll 451*b* in the sheet transport direction. The upper transport roll 449*a* is connected to a not-shown driving source such as a motor to be a driving roll capable of generating a rotational force. The bundle of sheets PS is nipped between the upper transport roll 449*a* and the lower transport roll 449*b* and is outputted to the outside of the device by the rotational force. The surface of the upper transport roll 449*a* is formed of a rubber material such as EPDM and epichlorohydrin rubber. The lower transport roll 449*b* rotates to follow the upper transport roll 449*a*, and is a pinch roll made of a resin material or the like.

Similar to the upper folder roll 451*a* and the lower folder roll 451*b* described above, each of the upper transport roll 449*a* and the lower transport roll 449*b* is configured with plural rolls that are arranged at intervals in the axial direction. The plural rolls of each of the upper transport roll 449*a* and the lower transport roll 449*b* have the same length in the axial direction and are arranged to face each other.

However, the plural rolls of each of the upper transport roll 449*a* and the lower transport roll 449*b* are arranged to positions different in the axial direction from those of the upper folder roll 451*a* and the lower folder roll 451*b*. In other words, the plural rolls of each of the upper transport roll 449*a* and the lower transport roll 449*b* are arranged to positions corresponding to the positions where the blade sections 447*a* of the folder knife 447 are arranged. Or to put it another way, the plural rolls of each of the upper transport roll 449*a* and the lower transport roll 449*b* are arranged to positions corresponding to positions where those of the upper folder roll 451*a* and the lower folder roll 451*b* are not arranged.

By arranging the plural rolls of each of the upper transport roll 449*a* and the lower transport roll 449*b* at such positions, the upper transport roll 449*a* and the lower transport roll 449*b* nip the portions of the bundle of sheets PS between the folds formed by the upper folder roll 451*a* and the lower folder roll 451*b*, to thereby further form the folds. That is, the folds are formed by the upper transport roll 449*a* and the lower transport roll 449*b* at the locations where no fold is formed by the upper folder roll 451*a* and the lower folder roll 451*b*. Consequently, the folds formed on the bundle of sheets PS become continuous.

By configuring the transport roll 449 as described above, it becomes possible to make the saddle-stitching unit 44 smaller and lighter, and further, reduce the production costs. In other words, the transport roll 449 is an output roll for outputting the bundle of sheets PS to the outside of the device as well as a folder roll for forming the fold on the bundle of sheets PS. Accordingly, compared to a case where rolls having these functions are separately provided, it becomes possible to make the saddle-stitching unit 44 smaller, and further, reduce the production costs. Moreover, since the transport roll 449 includes the plural rolls arranged at intervals, it is possible to reduce the production costs and make the transport roll 449 lighter compared to a case of forming the transport roll 449 as a single continuous roll.

The gears 452*a* and 452*b* are an example of a pair of transmitting members that transmit a force for rotating the upper folder roll 451*a* and the lower folder roll 451*b*. That is, the gears 452*a* and 452*b* are connected to the upper folder roll 451*a* and the lower folder roll 451*b*, respectively, and are rotated by a not-shown driving source such as a motor. Accordingly, the gears 452*a* and 452*b* cause the upper folder roll 451*a* and the lower folder roll 451*b* to rotate.

The upper arm 453*a* and the lower arm 453*b* are an example of a pair of arm members to which the upper folder roll 451*a* and the lower folder roll 451*b* are attached.

The upper arm 453*a* and the lower arm 453*b* are rotatable around the rotation centers of the gears 452*a* and 452*b*, respectively. In FIG. 4, the rotational directions are indicated by the directions T1, T2, T3 and T4. When the bundle of sheets PS is pressed by the folder knife 447 and enters between the upper folder roll 451*a* and the lower folder roll 451*b*, the upper arm 453*a* and the lower arm 453*b*, which are individual arms, rotate in opposite directions from each other around a fulcrum at the downstream side. In FIG. 4, these directions are T2 and T4. Then, due to these rotations, between the upper folder roll 451*a* and the lower folder roll 451*b*, a space for nipping the bundle of sheets PS is formed.

The spring member 454 is an example of an elastic member for connecting the upper arm 453*a* and the lower arm 453*b* at the upstream side in the sheet transport direction.

The spring member 454 causes forces to act on the upper arm 453*a* and the lower arm 453*b* in the directions of pulling each other. In other words, by the spring member 454, a force in the downward direction in the figure is applied to the upper arm 453*a*, and a force in the upward direction in the figure is applied to the lower arm 453*b*.

Consequently, also on the upper folder roll 451*a* and the lower folder roll 451*b*, forces in the directions of approaching each other are applied. That is, the spring member 454 generates a force to nip the bundle of sheets PS via the upper arm 453*a* and the lower arm 453*b*.

By configuring the folder roll portion 448 as described above, it is possible to stably nip the bundle of sheets PS by the upper folder roll 451*a* and the lower folder roll 451*b*, and the portions where the fold is to be formed are hardly misaligned. In other words, the upper arm 453*a* and the lower arm 453*b* are vertically symmetrical and are connected with each other by the single spring member 454. This allows the forces of substantially the same magnitude to act the upper folder roll 451*a* and the lower folder roll 451*b* when the bundle of sheets PS enters between the upper folder roll 451*a* and the lower folder roll 451*b*, and thereby the upper folder roll 451*a* and the lower folder roll 451*b* move substantially the same distance to form a space to nip the bundle of sheets PS. Consequently, when the bundle of sheets PS is nipped, the bundle of sheets PS is hardly misaligned in the vertical direction or the width direction, and accordingly, the portions where the fold is to be formed become hardly misaligned. On the other hand, in a case where the upper arm 453*a* and the lower arm 453*b* have different shapes or each of the upper arm 453*a* and the lower arm 453*b* generates the force to nip the bundle of sheets PS by a different spring member, magnitudes of the forces to act on the upper arm 453*a* and the lower arm 453*b* or positions where the forces are applied are hardly the same. Therefore, the bundle of sheets PS is easily misaligned and the positions of the fold also become easily misaligned.

It should be noted that, as shown in FIG. 4, the upper arm 453*a* and the lower arm 453*b* may be formed such that the distance between the portions to which the spring member 454 is connected becomes larger than the distance between the rotation centers of the upper folder roll 451*a* and the lower folder roll 451*b*. In other words, the portions to which the spring member 454 is connected may be farther from each other. This allows the larger force to be easily applied by the upper arm 453*a* and the lower arm 453*b* when the bundle of sheets PS is nipped, and makes it possible to reduce a spring constant of the spring member 454. By reducing the spring constant, the spring member 454 becomes resistant to be deteriorated and the forces to act on the upper arm 453*a* and the lower arm 453*b* become hardly fluctuate. Accordingly, the portions where the fold is to be formed become hardly misaligned further.

Next, description will be given of an operation of making the fold on the bundle of sheets PS by use of the folder knife 447, the folder roll portion 448 and the transport roll 449 with the above-described configurations.

Figure 8B:
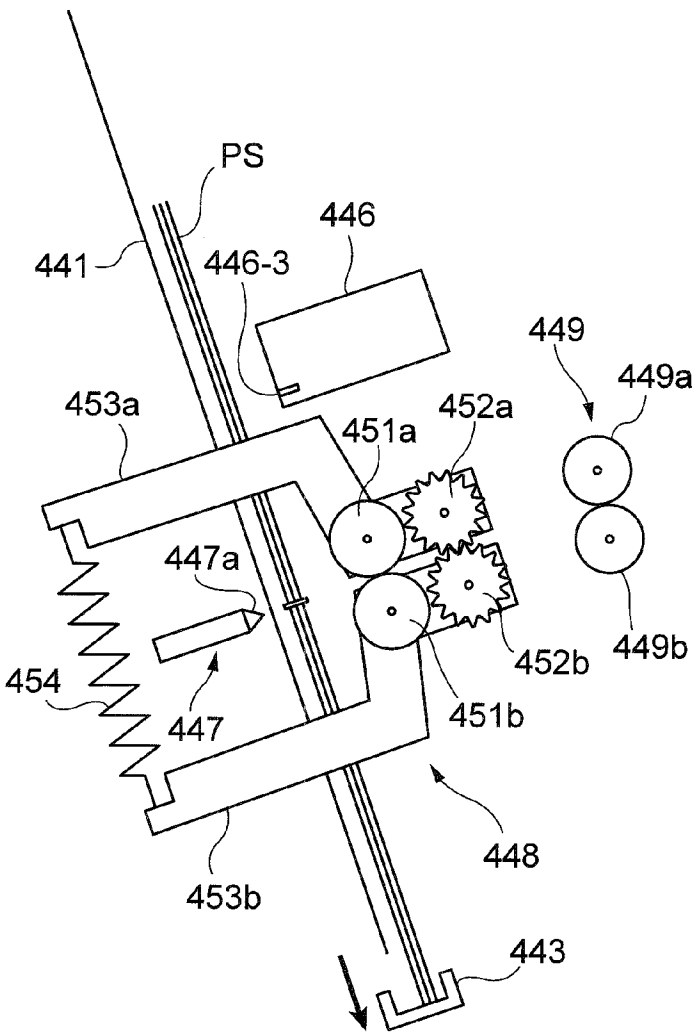
FIGS. 8A to 8E are diagrams illustrating an operation of making a fold on a bundle of sheets by use of the folder knife, the folder roll portion and the transport roll.

FIGS. 8A to 8E are diagrams illustrating the operation of making the fold on the bundle of sheets PS by use of the folder knife 447, the folder roll portion 448 and the transport roll 449. FIGS. 9A and 9B are diagrams illustrating the fold U made on the bundle of sheets PS at this time.

Figure 8A:
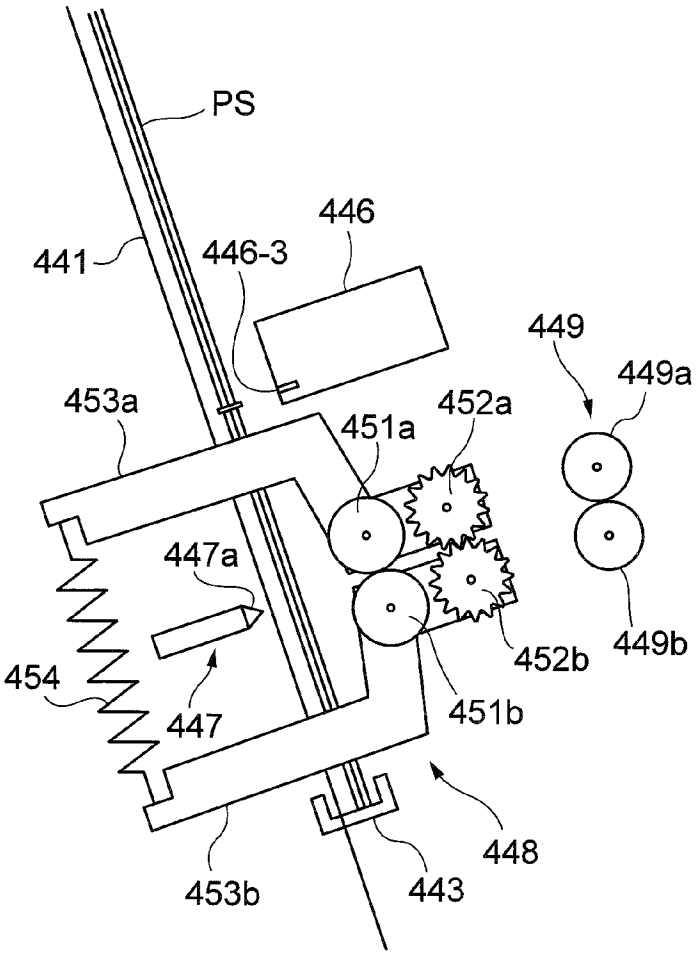
Figure 9A:
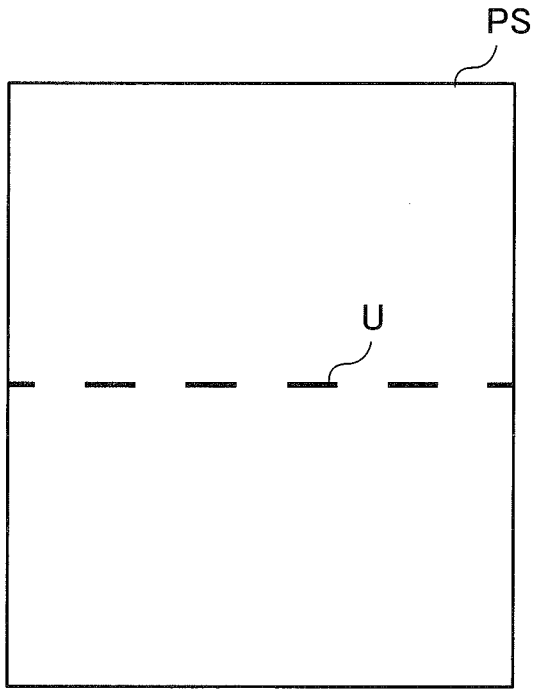
FIGS. 9A and 9B are diagrams illustrating the fold made on the bundle of sheets at this time.
Figure 9B:
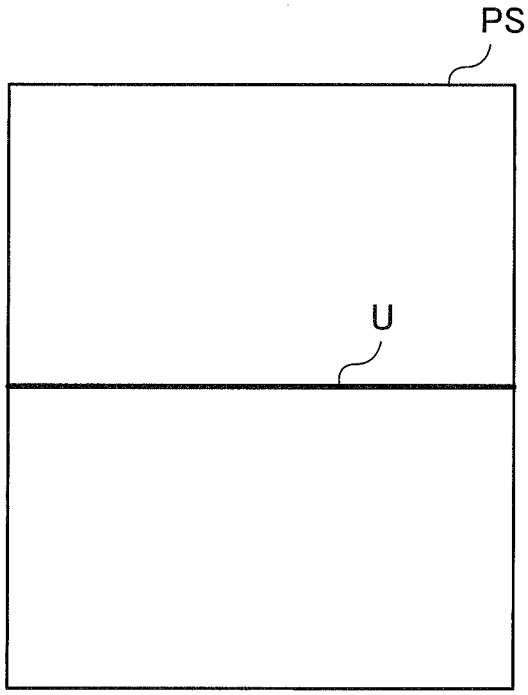

First, as described above, the bundle of sheets PS is stacked on the sheet stacker 441 and the portion of the bundle of sheets PS where the fold is to be made is saddle-stitched by the stapler 446 (FIG. 8A). Subsequently, the saddle-stitched bundle of sheets PS is moved by the downward movement of the end guide 443 such that the portion to be folded coincides with the tip end position of the folder knife 447 (FIG. 8B).

Figure 8D:
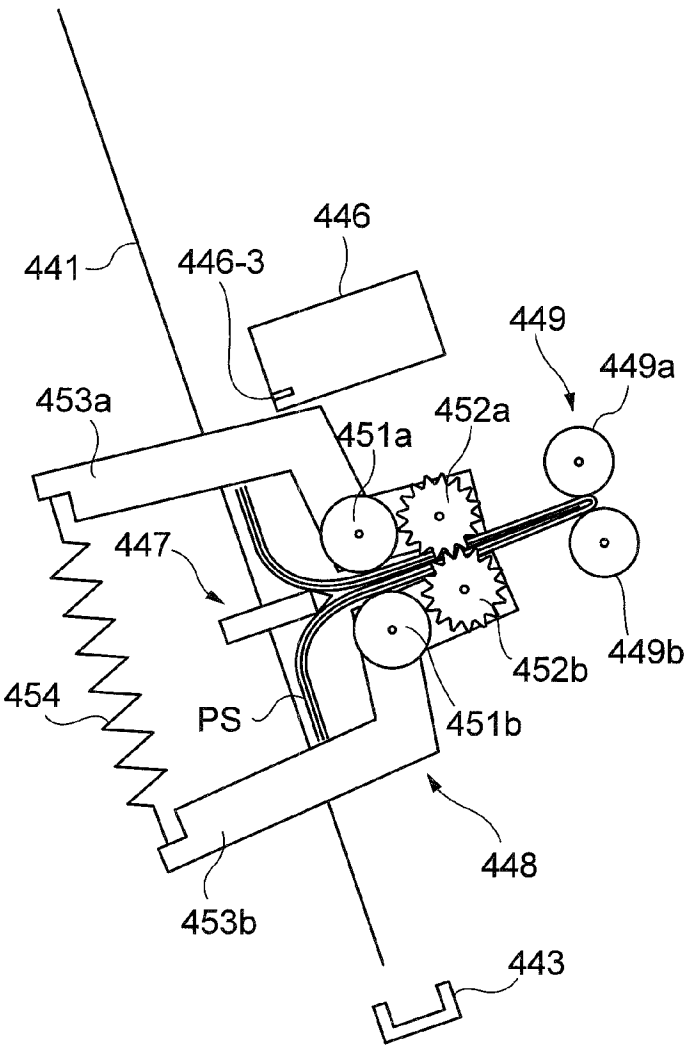
Figure 8C:
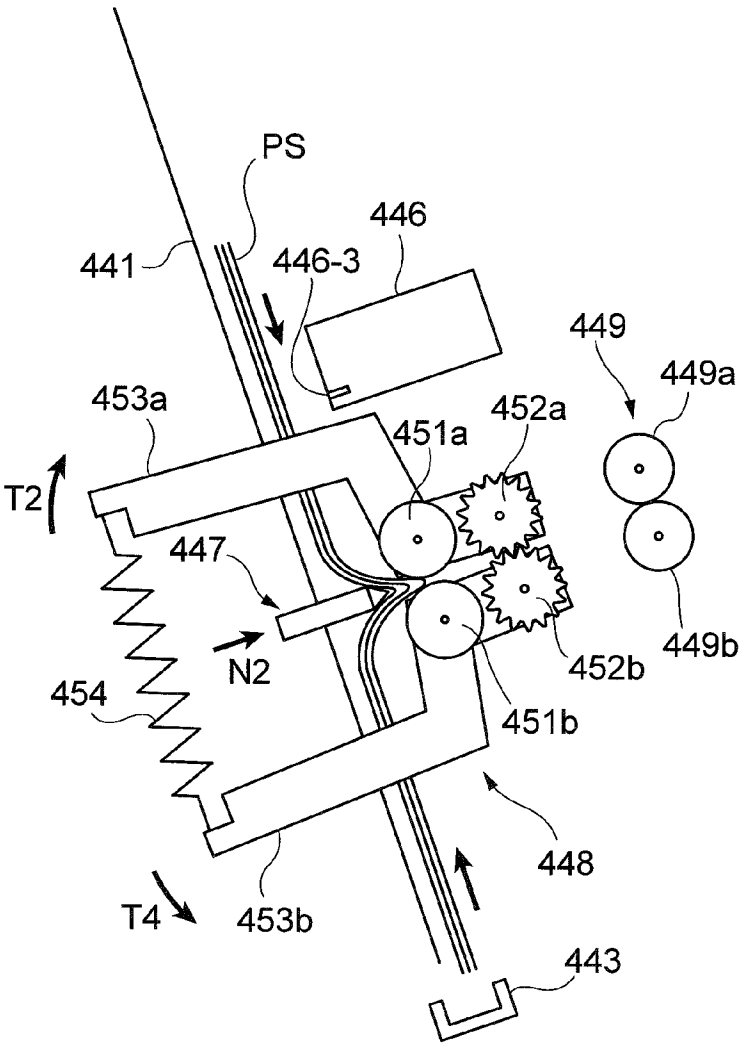

Next, when the folder knife 447 is pushed out from the back side toward the front side of the sheet stacker 441, the portion of the bundle of sheets PS where the fold is to be formed is pushed out in the direction of the folder roll 451 (the direction N2) to be nipped between the upper folder roll 451*a* and the lower folder roll 451*b* (FIG. 8C). At this time, the upper arm 453*a* and the lower arm 453*b* rotate in the direction T2 and the direction T4 around the rotation centers of the gears 452*a* and 452*b* as fulcrums, respectively. Then, between the upper folder roll 451*a* and the lower folder roll 451*b*, a space for nipping the bundle of sheets PS is formed. Further, by a pulling force of the spring member 454, via the upper arm 453*a* and the lower arm 453*b*, the force to nip the bundle of sheets PS is applied between the upper folder roll 451*a* and the lower folder roll 451*b*. As a result, the folds U as shown in FIG. 9A are formed at intervals on the bundle of sheets PS.

The bundle of sheets PS nipped between the upper folder roll 451*a* and the lower folder roll 451*b* is transported by the rotational force of the upper folder roll 451*a* and the lower folder roll 451*b*, and the leading edge portion thereof reaches the transport roll 449. Then, the bundle of sheets PS is nipped again between the upper transport roll 449*a* and the lower transport roll 449*b* (FIG. 8D). At this time, folds are further formed between the folds U shown in FIG. 9A, and thereby the continuous fold U as shown in FIG. 9B is formed on the bundle of sheets PS.

Figure 8E:
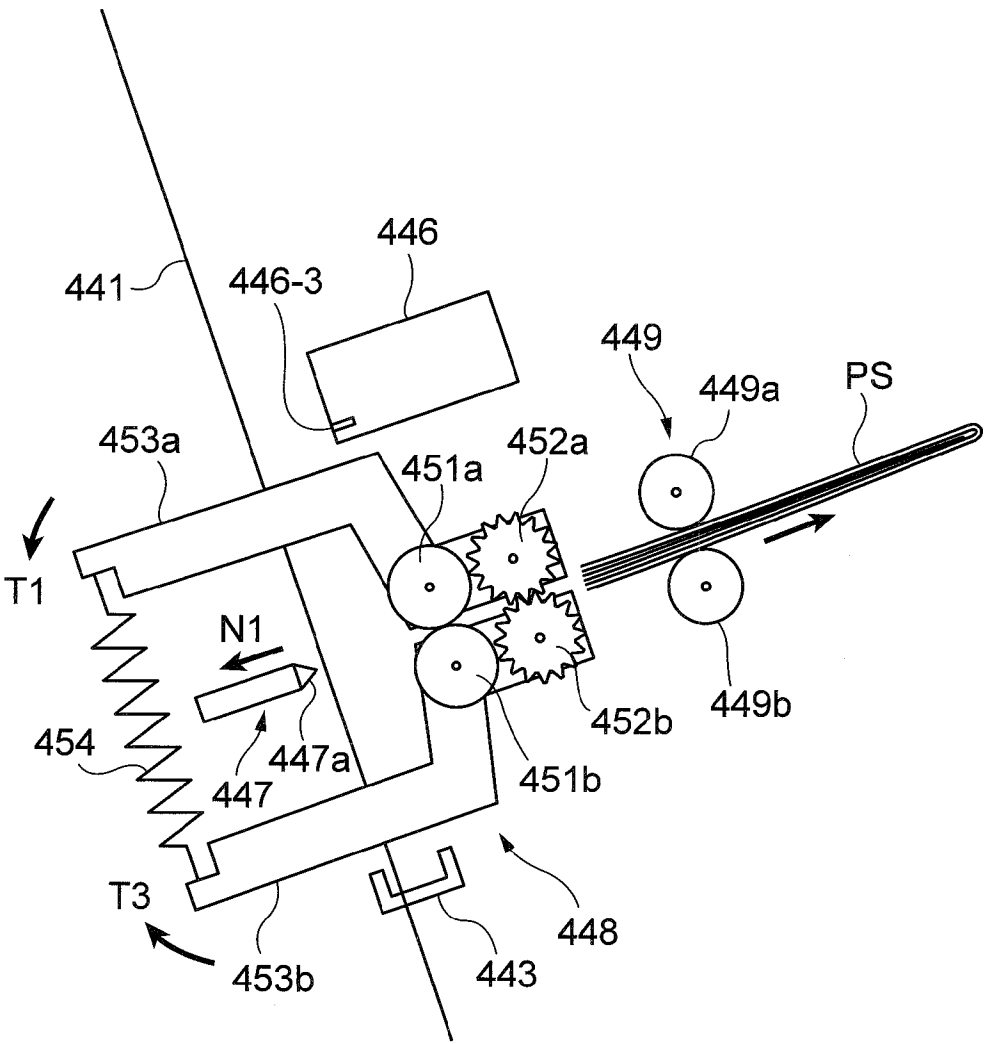

The bundle of sheets PS, on which the fold is formed in the manner as described above, is center-folded and outputted to the outside of the device by the rotational force of the upper transport roll 449*a* (FIG. 8E). At this time, the upper folder roll 451*a* and the lower folder roll 451*b* rotates in the direction T1 and the direction T3, respectively, by the pulling force of the spring member 454. The space formed between the upper folder roll 451*a* and the lower folder roll 451*b* disappears and the upper folder roll 451*a* and the lower folder roll 451*b* return to the state of being in contact with each other. The folder knife 447 moves in the direction N1 to be retracted behind the sheet stacker 441, to thereby return to the position where the sheets P are able to be stacked on the sheet stacker 441.

It should be noted that, in the saddle-stitching unit 44 described in detail above, the transport roll 449 is arranged corresponding to a position where the folder roll 451 is not arranged. However, the position where the folder roll 451 is arranged and the position where the transport roll 449 is arranged may overlap in the axial direction. This allows the continuous fold to be easily formed on the bundle of sheets PS.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment as chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material processing apparatus comprising:

a stacker that stacks recording materials that are sequentially transported to form a bundle of recording materials;

a pressing member that includes blade sections arranged at intervals in a width direction of the bundle of recording materials, the blade sections pressing portions of the bundle of recording materials, where folds are to be formed, stacked on the stacker, to thereby move the portions of the bundle of recording materials, where the folds are to be formed, in a recording material transport direction;

a pair of first fold-forming rolls, each of which includes a plurality of rolls arranged at intervals so as to enter between the blade sections when the blade sections press the portions of the bundle of recording materials where folds are to be formed, the pair of first fold-forming rolls forming the folds at intervals by nipping the portions of the bundle of recording materials, where folds are to be formed, having been pressed by the blade sections; and a pair of second fold-forming rolls provided at a downstream side of the pair of first fold-forming rolls in the recording material transport direction, each of which includes a plurality of rolls arranged at intervals so as to correspond to positions where the blade sections of the pressing member are arranged, the pair of second fold-forming rolls further forming the folds on the bundle of recording materials by nipping portions of the bundle of recording materials, which exist between the folds formed by the pair of first fold-forming rolls.

2. The recording material processing apparatus according to claim 1, wherein the pair of second fold-forming rolls further has a function of outputting the bundle of recording materials to an outside of the apparatus.

3. The recording material processing apparatus according to claim 1, further comprising:

a pair of arm members to which the pair of first fold-forming rolls is attached; and an elastic member that connects the arm members of the pair of arm members at an upstream side in the recording material transport direction, wherein the individual arm members of the pair of arm members rotate in directions opposite to each other around fulcrums at a downstream side to form a space for nipping a bundle of recording materials between the pair of first fold-forming rolls, and the elastic member generates a force for nipping the bundle of recording materials via the pair of arm members.

4. The recording material processing apparatus according to claim 2, further comprising:

a pair of arm members to which the pair of first fold-forming rolls is attached; and an elastic member that connects the arm members of the pair of arm members at an upstream side in the recording material transport direction, wherein the individual arm members of the pair of arm members rotate in directions opposite to each other around fulcrums at a downstream side to form a space for nipping a bundle of recording materials between the pair of first fold-forming rolls, and the elastic member generates a force for nipping the bundle of recording materials via the pair of arm members.

5. The recording material processing apparatus according to claim 3, further comprising:

a pair of transmitting members that transmits a force for rotating the pair of first fold-forming rolls, wherein the pair of arm members rotate around rotation centers of the pair of transmitting members as the fulcrums.

6. The recording material processing apparatus according to claim 4, further comprising:

a pair of transmitting members that transmits a force for rotating the pair of first fold-forming rolls, wherein the pair of arm members rotate around rotation centers of the pair of transmitting members as the fulcrums.

7. The recording material processing apparatus according to claim 3, wherein the individual arm members of the pair of arm members are formed such that a distance between portions thereof to which the elastic member is connected becomes larger than a distance between rotation centers of the individual first fold-forming rolls of the pair of first fold-forming rolls.

8. The recording material processing apparatus according to claim 4, wherein the individual arm members of the pair of arm members are formed such that a distance between portions thereof to which the elastic member is connected becomes larger than a distance between rotation centers of the individual first fold-forming rolls of the pair of first fold-forming rolls.

9. The recording material processing apparatus according to claim 5, wherein the individual arm members of the pair of arm members are formed such that a distance between portions thereof to which the elastic member is connected becomes larger than a distance between rotation centers of the individual first fold-forming rolls of the pair of first fold-forming rolls.

10. The recording material processing apparatus according to claim 6, wherein the individual arm members of the pair of arm members are formed such that a distance between portions thereof to which the elastic member is connected becomes larger than a distance between rotation centers of the individual first fold-forming rolls of the pair of first fold-forming rolls.

11. A recording material processing system comprising:

an image forming apparatus that forms an image on a recording material; and a recording material processing apparatus that forms a fold on a bundle of recording materials formed by stacking the recording materials on each of which the image is formed by the image forming apparatus, wherein the recording material processing apparatus comprises:

a stacker that stacks the recording materials that are sequentially transported to form the bundle of recording materials;

a pressing member that includes blade sections arranged at intervals in a width direction of the bundle of recording materials, the blade sections pressing portions of the bundle of recording materials, where folds are to be formed, stacked on the stacker, to thereby move the portions of the bundle of recording materials, where the folds are to be formed, in a recording material transport direction;

a pair of first fold-forming rolls, each of which includes a plurality of rolls arranged at intervals so as to enter between the blade sections when the blade sections press the portions of the bundle of recording materials where folds are to be formed, the pair of first fold-forming rolls forming the folds at intervals by nipping the portions of the bundle of recording materials, where folds are to be formed, having been pressed by the blade sections; and a pair of second fold-forming rolls provided at a downstream side of the pair of first fold-forming rolls in the recording material transport direction, each of which includes a plurality of rolls arranged at intervals so as to correspond to positions where the blade sections of the pressing member are arranged, the pair of second fold-forming rolls further forming the folds on the bundle of recording materials by nipping portions of the bundle of recording materials, which exist between the folds formed by the pair of first fold-forming rolls.

* * * * *